US006736671B2

(12) United States Patent
Lee

(10) Patent No.: US 6,736,671 B2
(45) Date of Patent: May 18, 2004

(54) ELECTRONIC CARD CONNECTOR

(75) Inventor: Ipson Lee, Taoyuan (TW)

(73) Assignee: Super Link Electronics Co., Ltd., Taoyuan (TW)

( * ) Notice: Subject to any disclaimer, the term of this patent is extended or adjusted under 35 U.S.C. 154(b) by 0 days.

(21) Appl. No.: 10/207,760

(22) Filed: Jul. 31, 2002

(65) Prior Publication Data

US 2004/0023553 A1 Feb. 5, 2004

(51) Int. Cl.[7] ..... H01R 13/66
(52) U.S. Cl. ..... 439/541.5; 439/64
(58) Field of Search ..... 439/64, 541.5, 439/79

(56) References Cited

U.S. PATENT DOCUMENTS 5,688,130 A * 11/1997 Huang ..... 439/79
5,738,532 A * 4/1998 Takano et al. ..... 439/79
5,775,923 A * 7/1998 Tomioka ..... 439/79
6,033,258 A * 3/2000 Huang et al. ..... 439/541.5
6,183,273 B1 * 2/2001 Yu et al. ..... 439/92
6,305,951 B1 * 10/2001 Shih et al. ..... 439/79

* cited by examiner

*Primary Examiner*—Gary Pauman
*Assistant Examiner*—James R. Harvey
(74) *Attorney, Agent, or Firm*—Rosenberg, Klein & Lee

(57) ABSTRACT

An electronic card connector including a pin socket having two step sections at different heights. The lower connector has straightly extending conductive terminals bridged with the step sections from a lateral side of the pin socket. The upper face of the pin socket is formed with insertion holes. The upper connector has bending conductive terminals inserted in the insertion holes. The height of the pin socket is lowered so that when the pin socket passes through the soldering furnace along with the circuit board, the pin socket will not fall down. Moreover, the structure of conductive terminals of the two connectors are simplified and the manufacturing procedure is simplified.

3 Claims, 8 Drawing Sheets

ELECTRONIC CARD CONNECTOR

BACKGROUND OF THE INVENTION

FIELD OF THE INVENTION

The present invention is related to an electronic card connector having lower height and wider bottom face. The electronic card connector can be more stably rested. In addition, the structure of the conductive terminals of the connector are simplified.

FIG. 6 shows a conventional electronic card connector. A second connector 12 is overlaid on a first connector 11. The first conductive pins 16 of the front end of the first connector 11 are windingly bent and inserted into the insertion holes 14 of a socket 13. The conductive pins 16 electrically contact with the conductive terminals 15 disposed in the insertion holes 14. The above structure has a shortcoming, that is, the first conductive pins 16 are windingly bent so that the processing procedure is complicated and time-consuming. In addition, the ratio of good product is quite low.

FIG. 7 shows a second type of conventional electronic card connector. A second connector 22 is overlaid on a first connector 21. The forward extending first and second conductive pins 23, 24 of the first and second connectors 21, 22 are both first soldered on a circuit board 25 and then the circuit board 25 is inserted in an insertion slot 28 of a socket 27 soldered on a circuit board 26. The conductive pins 23, 24 electrically contact with the conductive terminals 29 disposed in the insertion slot 28. The above structure has a shortcoming, that is, the socket 27 must be first soldered on the circuit board 26 and then the circuit board 25 is inserted into the socket 27. The processing time is long and the processing cost is high.

FIG. 8 shows a third type of conventional electronic card connector. A second connector 32 is overlaid on a first connector 31. The socket 33 has four steps of insertion slots 34. A conductive terminal is inserted in each insertion slot 34. The forward extending first and second conductive pins 37, 38 of the first and second connectors 31, 32 are respectively inserted in the insertion slots 34 to contact with the conductive terminals 35. The above structure has a shortcoming, that is, the socket 33 must be formed with four steps of insertion slots 34 at different heights. Therefore, the socket 33 will have a considerable height. When the socket 33 disposed on the circuit board 36 passes through the soldering furnace along with the circuit board 36, the socket 33 is too high and tends to fall down. This makes it impossible to solder the socket 33 on the circuit board 36.

SUMMARY OF THE INVENTION

It is therefore a primary object of the present invention to provide an electronic card connector in which the bottom face of the pin socket is wider and the height of the pin socket is lowered. Therefore, the pin socket can stably pass through the soldering furnace without falling down.

It is a further object of the present invention to provide the above electronic card connector in which the structure of the conductive terminal is simplified. Therefore, the electronic card connector is easier to manufacture and process.

According to the above objects, the electronic card connector of the present invention includes a pin socket, a first connector and a second connector. The pin socket is disposed on a circuit board. The pin socket includes an insulating seat, a first conductive terminal and a second conductive terminal.

The insulating seat has: a first face soldered on a circuit board; a second face opposite to the first face: a third face formed on one side of the first face and second face; multiple insertion holes extending from the second face to the first face and passing through the first face and second face; a first step section formed on the other side of the first face of the pin socket; multiple first insertion slots passing through the first step section and the first face; a second step section formed on an edge of the first step section, the second step section being lower than the first step section; multiple second insertion slots passing through the second step section and the first face; a first end formed at one end of the first face, second face, third face, first step section and second step section; and a second end formed at the other end of the first face, second face, third face, first step section and second step section.

One end of the first conductive terminal is inserted in each first insertion slot of the first step section and each second insertion slot of the second step section of the pin socket. The other end of the first conductive terminal is soldered on the circuit board.

One end of the second conductive terminal is inserted in each insertion hole of the pin socket. The other end of the second conductive terminal is soldered on the circuit board.

The first connector has: a first side; a second side opposite to the first side; a third side, two ends of the third side being connected with two corresponding ends of the first side and second side; and a fourth side, two ends of the fourth side being connected with two other corresponding ends of the first side and second side, the third side and fourth side being respectively formed with insertion channels, the two insertion channels respectively having openings on the second side, whereby an electronic card can be inserted into the two openings, a group of first conductive pins being inlaid in the first side, the first conductive pins extending from the first side in a first direction distal from the second side, the first conductive pins respectively riding in the first insertion slots of the first step section and the second insertion slots of the second step section and being bridged with the first conductive terminals.

The second connector is overlaid on the first connector. The second connector has: a first side; a second side opposite to the first side; a third side, two ends of the third side being connected with two corresponding ends of the first side and second side; and a fourth side, two ends of the fourth side being connected with two other corresponding ends of the first side and second side, the third side and fourth side being respectively formed with insertion channels, the insertion channels respectively having openings on the second side, whereby an electronic card can be inserted into the two openings, a group of second conductive pins being inlaid in the first side, the first conductive pins extending from the first side in a first direction distal from the second side and then 90 degrees tuning and extending in a second direction, the second conductive pins being respectively inserted in the insertion holes of the second face of the pin socket and contacting with the second conductive terminals.

The electronic card connector further includes a protective member attaching to the second face of the pin socket. The protective member has multiple through holes respectively corresponding to the insertion holes. The group of second conductive pins of the second connector are passed through the through holes for protecting the second conductive pins.

The present invention can be best understood through the following description and accompanying drawings wherein:

DETAILED DESCRIPTION OF THE PREFERRED EMBODIMENT

Figure 1:
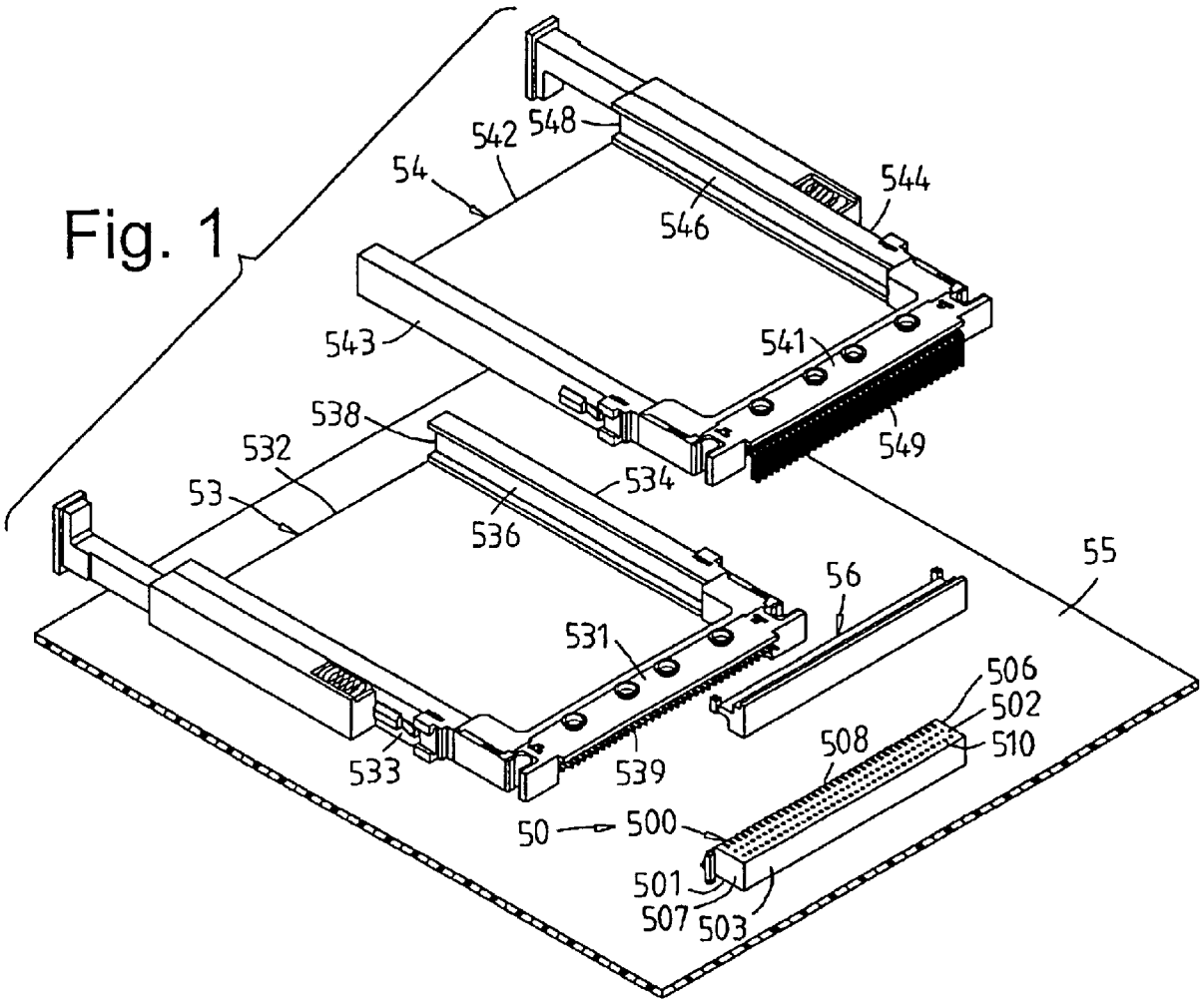
FIG. 1 is a perspective exploded view of the present invention, seen from front side, right side and upper side.

Please refer to FIGS. 1 to 5. The electronic card connector of the present invention includes a pin socket 50, a first conductive terminal 51, a second conductive terminal 52, a first connector 53 and a second connector 54.

Figure 2:
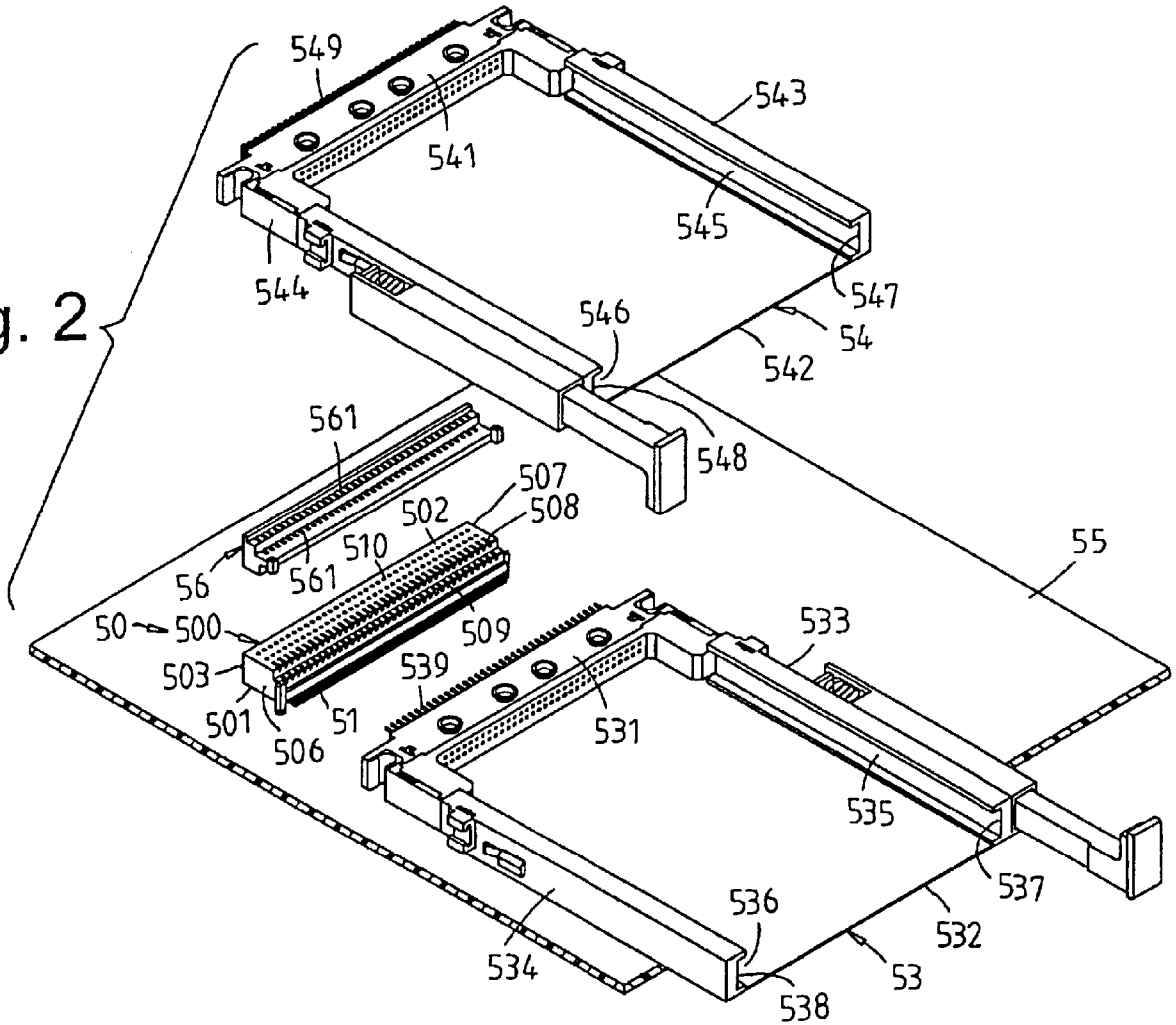
FIG. 2 is a perspective exploded view of the present invention, seen from rear side, left side and upper side.
Figure 3:
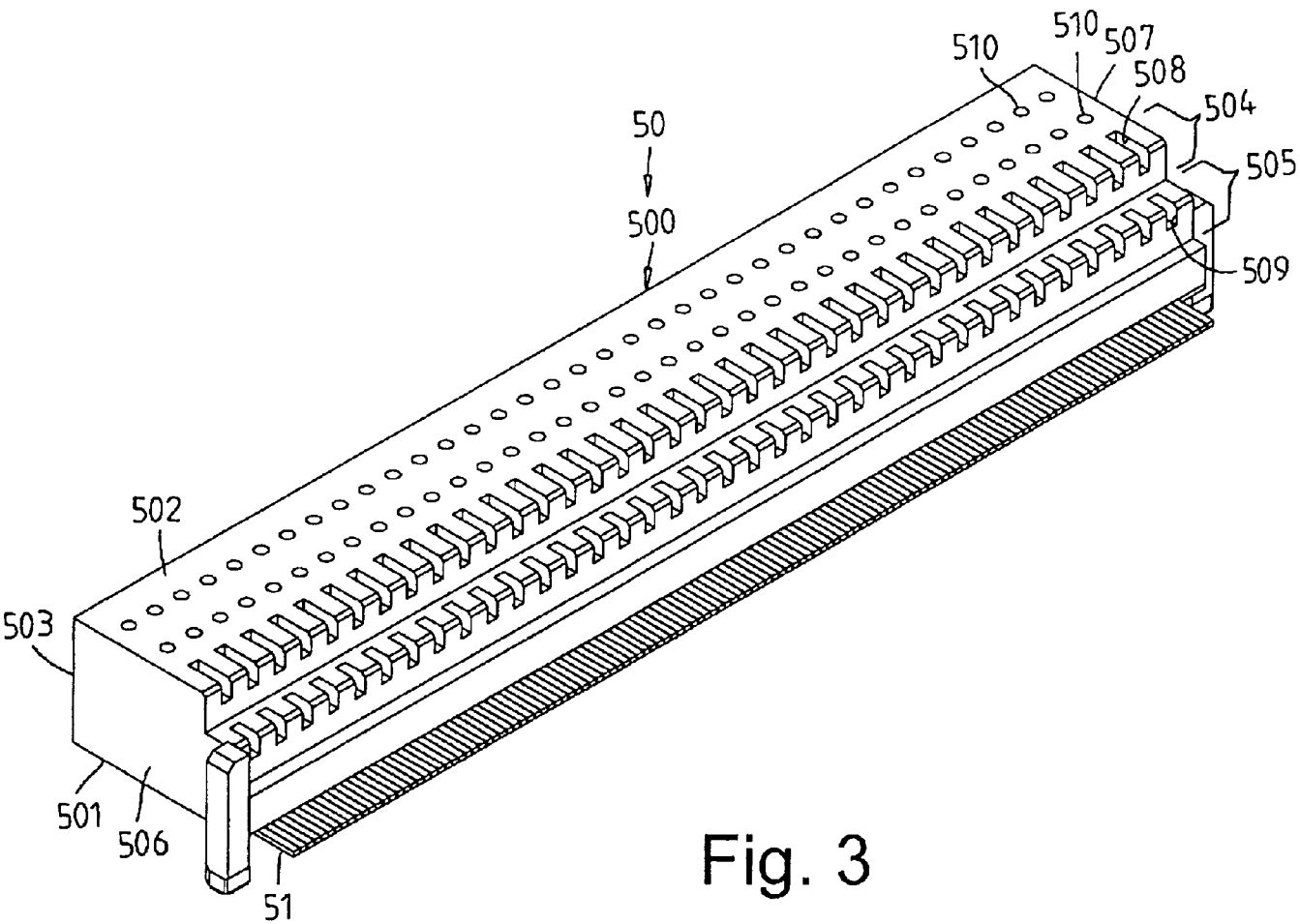
FIG. 3 is an enlarged view of the pin socket of FIG. 2.
Figure 5:
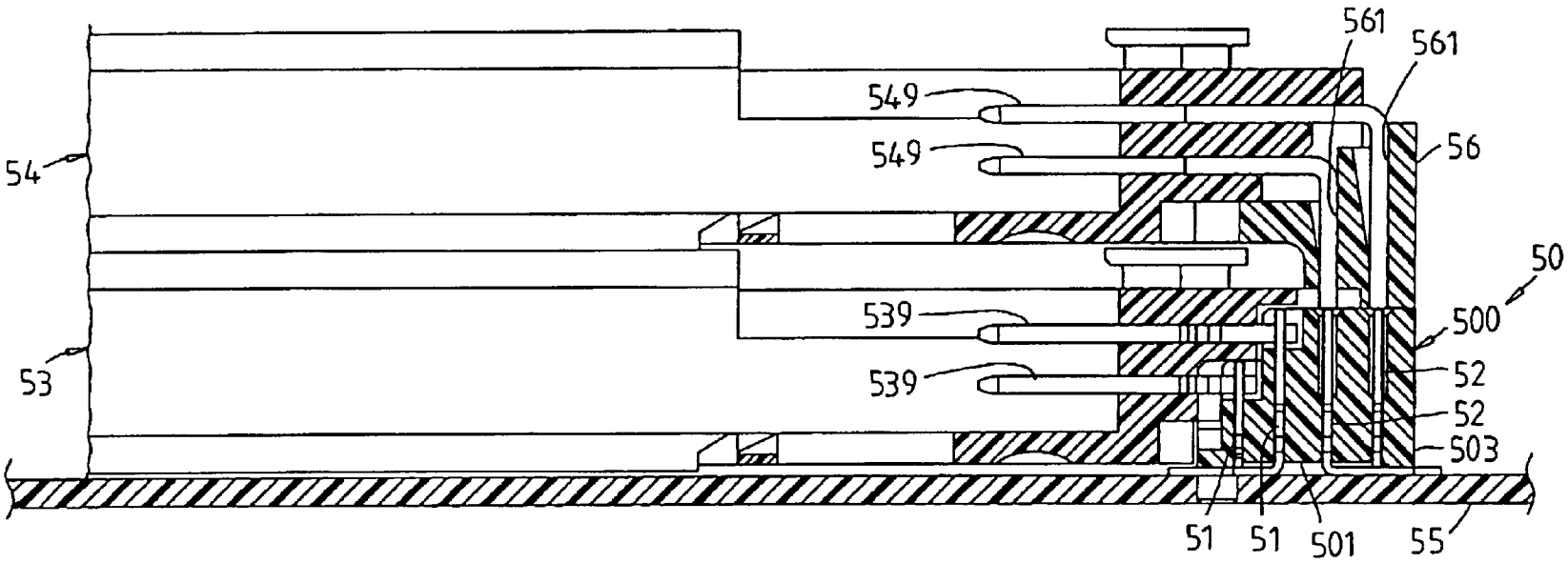
FIG. 5 is a partially sectional view taken along line 5—5 of FIG. 4.
Figure 6:
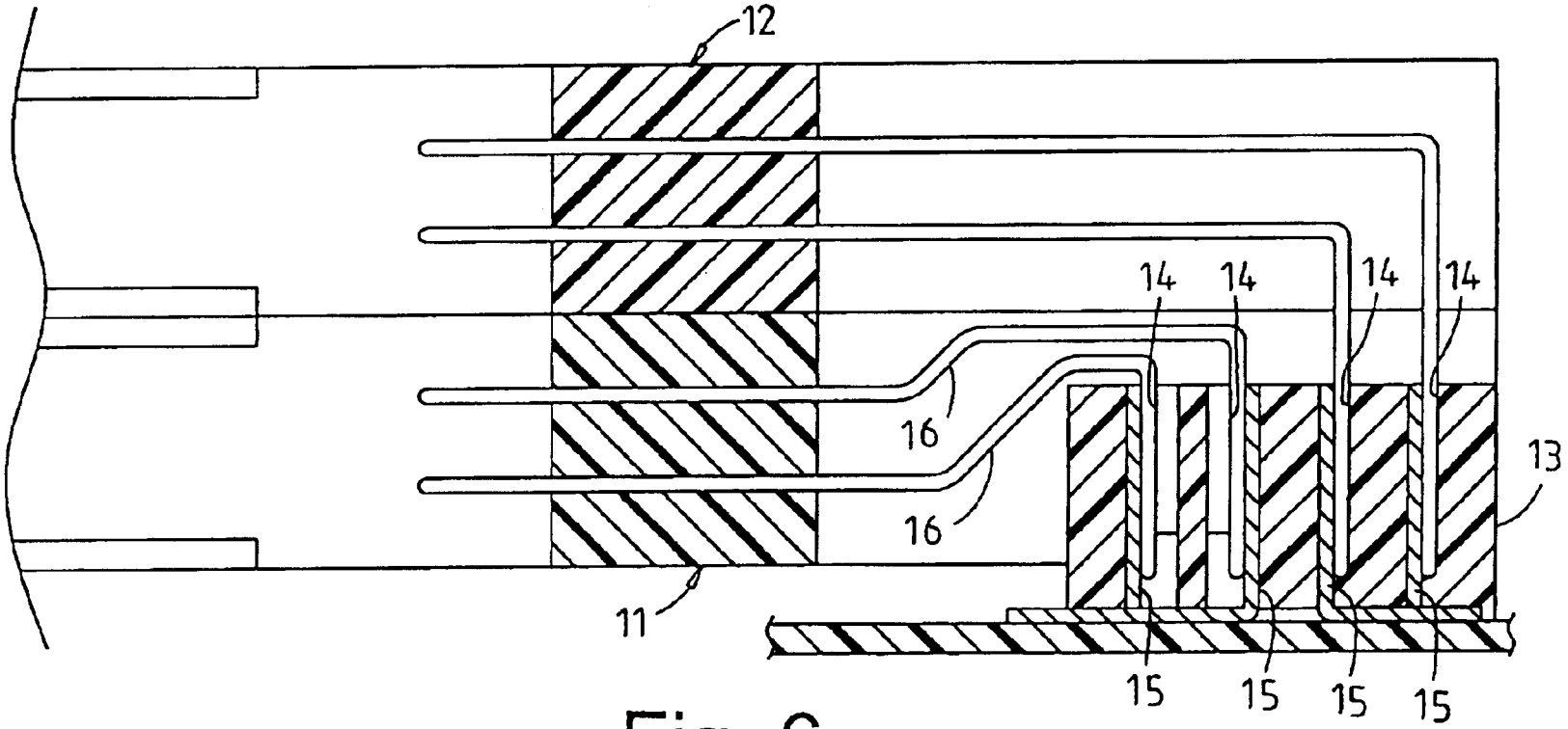
Fig. 6 PRIOR ART
FIG. 6 is a partially sectional view of a first type of conventional electronic card connector.
Figure 7:
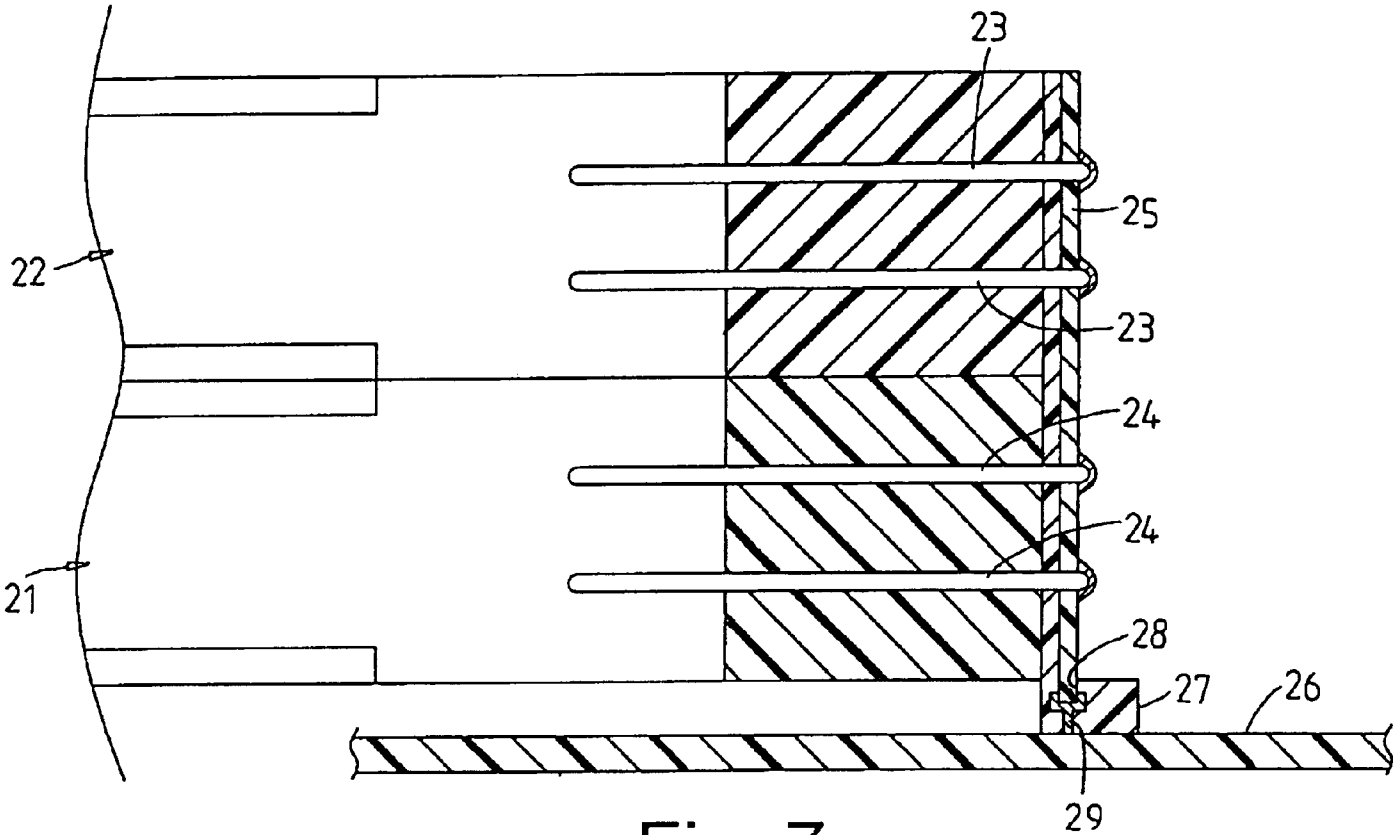
Fig. 7 PRIOR ART
FIG. 7 is a partially sectional view of a second type of conventional electronic card connector.
Figure 8:
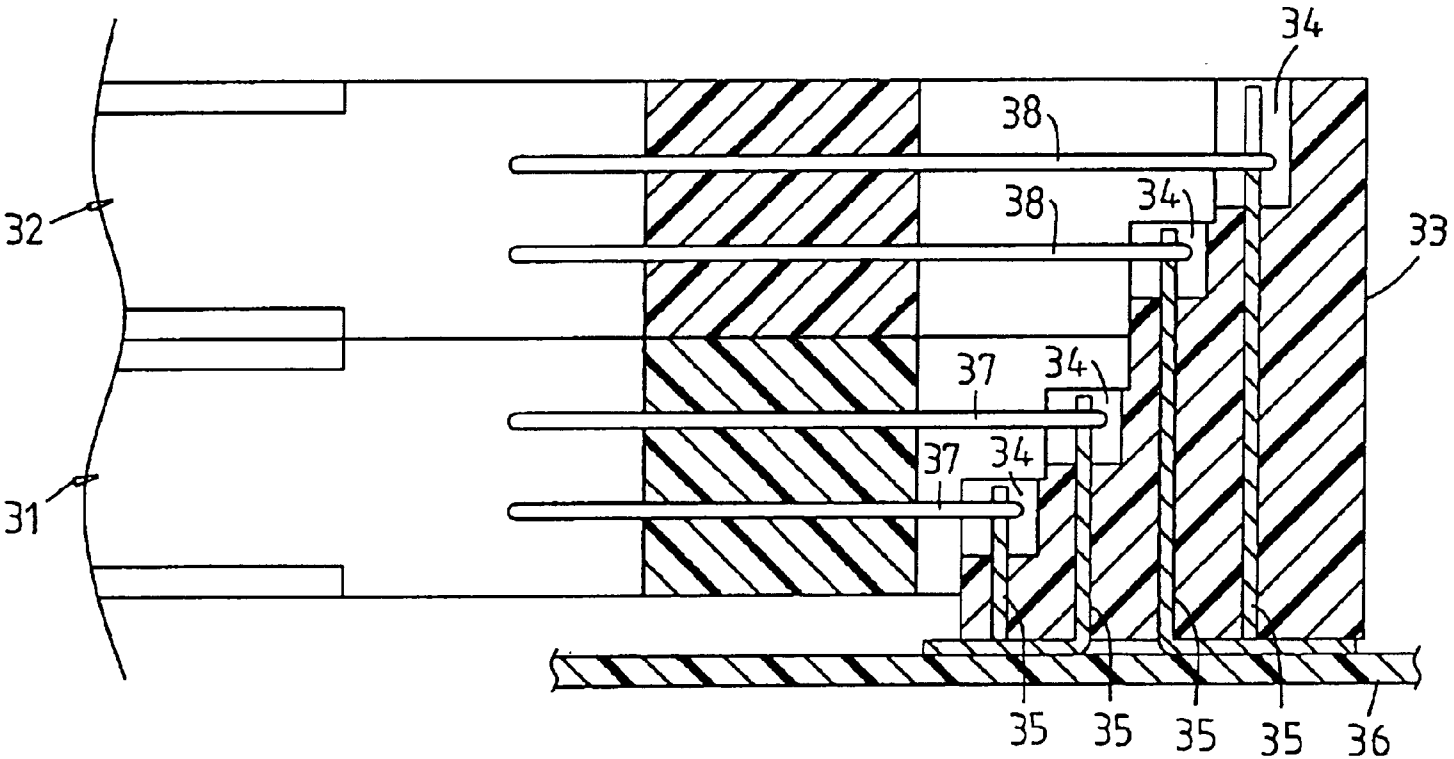
Fig. 8 PRIOR ART
FIG. 8 is a partially sectional view of a third type of conventional electronic card connector.

Referring to FIGS. 2, 3 and 5, the pin socket 50 is disposed on a circuit board 55. Referring to FIGS. 3 and 5, the pin socket 50 includes an insulating seat 500, a first conductive terminal 51 and a second conductive terminal 52. The insulating seat 500 has a first face 501, a second face 502, a third face 503, a first step section 504, a second step section 505, a first end 506, a second end 507, multiple first insertion slots 508, multiple second insertion slots 509 and multiple insertion holes 510.

Figure 4:
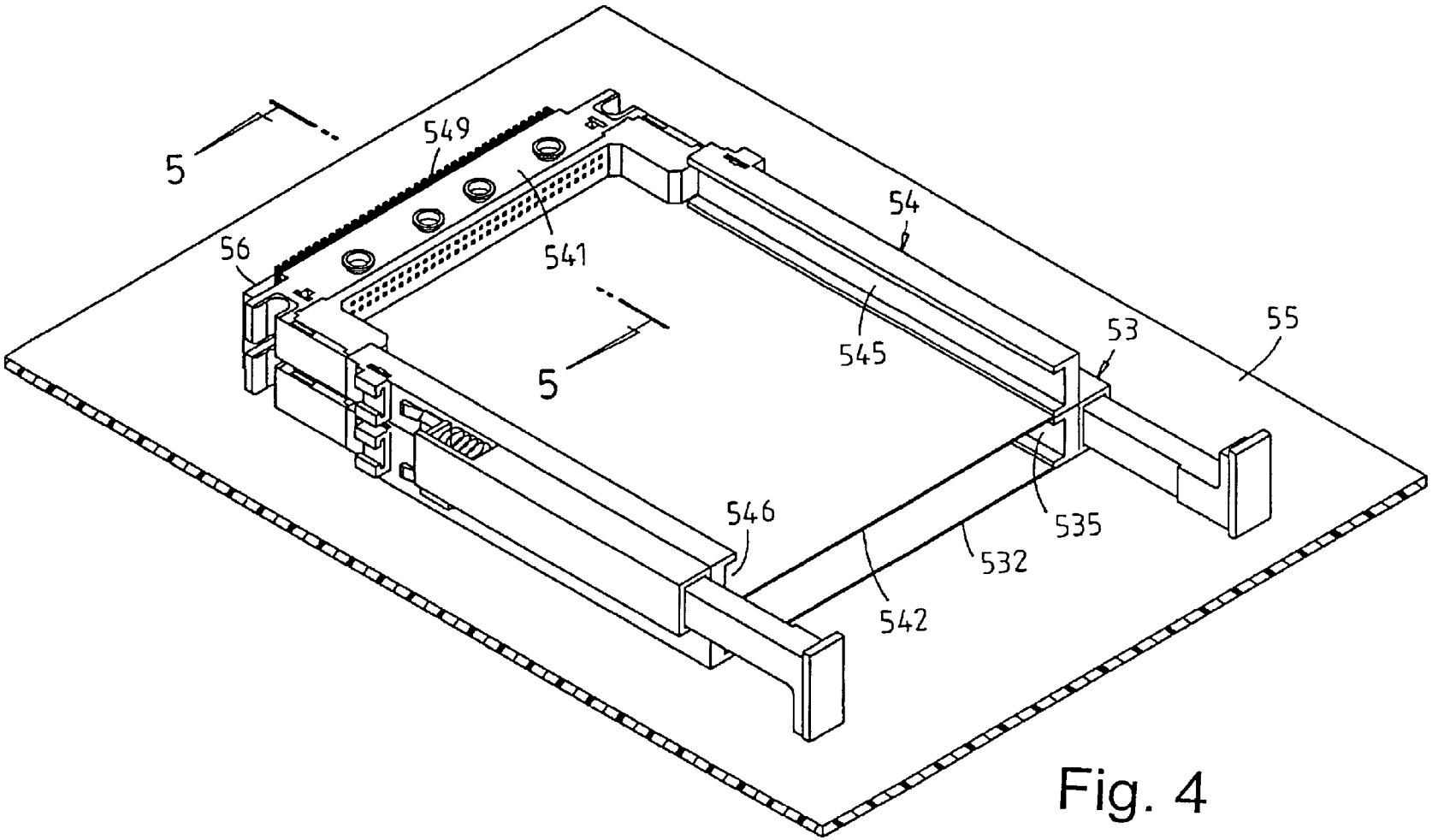
FIG. 4 is a perspective assembled view of the present invention.

Referring to FIGS. 3, 4 and 5, the first face 501 is soldered on the circuit board 55. The second face 502 is opposite to the first face 501. The third face 503 is formed on one side of the first face 501 and second face 502. The first end 506 is formed at one end of the first face 501, second face 502, third face 503, first step section 504 and second step section 505. The second end 507 is formed at the other end of the first face 501, second face 502, third face 503, first step section 504 and second step section 505.

Referring to FIGS. 3 and 5, the insertion holes 510 extend from the second face 502 to the first face 501 and pass through the first face 501 and second face 502.

Referring to FIGS. 3 and 5, the first step section 504 is formed on the other side of the first face 501 of the pin socket 50. The first insertion slots 508 pass through the first step section 504 and the first face 501.

Referring to FIGS. 3 and 5, the second step section 505 is formed on an edge of the first step section 504. The second step section 505 is lower than the first step section 504. The second insertion slots 509 pass through the second step section 505 and the first face 501.

Referring to FIG. 5, one end of the first conductive terminal 51 is inserted in each first insertion slot 508 of the first step section 504 and each second insertion slot 509 of the second step section 505 of the pin socket 50. The other end of the first conductive terminal 51 is soldered on the circuit board 55.

Referring to FIG. 5, one end of the second conductive terminal 52 is inserted in each insertion hole 510 of the pin socket 50. The other end of the second conductive terminal 52 is soldered on the circuit board 55.

Referring to FIGS. 1, 2, 4 and 5, the first connector 53 has a first side 531, a second side 532, a third side 533 and a fourth side 534. The second side 532 is opposite to the first side 531. Two ends of the third side 533 are connected with two corresponding ends of the first side 531 and second side 532. Two ends of the fourth side 534 are connected with two other corresponding ends of the first side 531 and second side 532. The third side 533 and fourth side 534 are respectively formed with insertion channels 535, 536. The two insertion channels 535, 536 respectively have openings 537, 538 on the second side 532, whereby an electronic card (not shown) can be inserted into the two openings 537, 538. A group of first conductive pins 539 are inlaid in the first side 531 of the first connector 53. The first conductive pins 539 extend from the first side 531 in a first direction distal from the second side 532. The first conductive pins 539 respectively ride in the first insertion slots 508 of the first step section 504 and the second insertion slots 509 of the second step section 505 and bridged with the first conductive terminals 51.

Referring to FIGS. 1, 2, 4 and 5, the second connector 54 is overlaid on the first connector 53. The second connector 54 has a first side 541, a second side 542, a third side 543 and a fourth side 544. The second side 542 is opposite to the first side 541. Two ends of the third side 543 are connected with two corresponding ends of the first side 541 and second side 542. Two ends of the fourth side 544 are connected with two other corresponding ends of the first side 541 and second side 542. The third side 543 and fourth side 544 are respectively formed with insertion channels 545, 546. The two insertion channels 545, 546 respectively have openings 547, 548 on the second side 542, whereby an electronic card (not shown) can be inserted into the two openings 547, 548. A group of second conductive pins 549 are inlaid in the first side 541. The first conductive pins 549 extend from the first side 541 in a first direction distal from the second side 542 and then 90 degrees turn and extend in a second direction. The second conductive pins 549 are respectively inserted in the insertion holes 510 of the second face 502 of the pin socket 50 and contact with the second conductive terminals 52.

Referring to FIGS. 1, 2, 4 and 5, the electronic card connector of the present invention further includes a protective member 56 attaching to the second face 502 of the pin socket 50. The protective member 56 has multiple through holes 561 respectively corresponding to the insertion holes 510. The group of second conductive pins 549 of the second connector 54 are passed through the through holes 561 for protecting the second conductive pins 549.

According to the above arrangement, the present invention has the following advantages:

1. The electronic card connector of the present invention widens the bottom face of the pin socket and lowers the height of the pin socket. Therefore, the pin socket can stably pass through the soldering furnace without falling down.
2. The electronic card connector of the present invention has simplified structure of conductive terminal and is easier to manufacture and process.

The above embodiment is only used to illustrate the present invention, not intended to limit the scope thereof. Many modifications of the above embodiment can be made without departing from the spirit of the present invention.

What is claimed is:

1. An electronic card connector comprising:

(A) a pin socket disposed on a circuit board, the pin socket including:

(a) an insulating seat having a first face soldered on a circuit board; a second face opposite to the first face;

a third face formed at one side of the first face and second face; multiple insertion holes extending from the second face to the first face and passing through the first face and second face; a first step section formed at another side of the first face of the pin socket; multiple first insertion slots passing through the first step section and the first face; a second step section formed at an edge of the first step section, the second step section being lower than the first step section; multiple second insertion slots passing through the second step section and the first face; the first face, second face, third face, first step section and second step section extending between first and second ends;

(b) a plurality of first conductive terminals each having opposed ends, one end of each first conductive terminal being inserted in at least one of the first and second insertion slots of the first and second step sections of the pin socket, the other end of each first conductive terminal being soldered on the circuit board; and, (c) a plurality of second conductive terminals each having opposed ends one end of each second conductive terminal being inserted in one insertion hole of the pin socket, the other end of each the second conductive terminal being soldered on the circuit board;

(B) a first connector having: a first side; a second side opposite to the first side; a third side, two ends of the third side being connected with two corresponding ends of the first side and second side; and a fourth side, two ends of the fourth side being connected with two other corresponding ends of the first side and second side, the third side and fourth side being respectively formed with insertion channels, the two insertion channels respectively having openings on the second side for receiving an electronic card, a group of first conductive pins being inlaid in the first side, the first conductive pins extending from the first side in a first direction distal from the second side, the first conductive pins respectively riding in the first insertion slots of the first step section and the second insertion slots of the second step section and being bridged with the first conductive terminals; and, (C) a second connector overlaid on the first connector, the second connector having a first side; a second side opposite to the first side; a third side, two ends of the third side being connected with two corresponding ends of the first side and second side; and a fourth side, two ends of the fourth side being connected with two other corresponding ends of the first side and second side, the third side and fourth side being respectively formed with insertion channels, the insertion channels respectively having openings on the second side for receiving an electronic card, a group of second conductive pins being inlaid in the first side, the first conductive pins extending from the first side in a first direction distal from the second side to a bend extending therefrom in a second direction, the second conductive pins being respectively inserted in the insertion holes of the second face of the pin socket and contacting with the second conductive terminals.

2. The electronic card connector as claimed in claim 1, further comprising a protective member attaching to the second face of the pin socket, the protective member having multiple through holes respectively corresponding to the insertion holes, the through holes receiving the group of second conductive pins of the second connector therethrough for protecting the second conductive pins.

3. An electronic card connector comprising a pin socket disposed on a circuit board, the pin socket including:

(a) an insulating seat having a first face soldered on a circuit board; a second face opposite to the first face; a third face formed at one side of the first face and second face; multiple insertion holes extending from the second face to the first face and passing through the first face and second face; a first step section formed at another side of the first face of the pin socket; multiple first insertion slots passing through the first step section and the first face; a second step section formed en at an edge of the first step section, the second step section being lower than the first step section; multiple second insertion slots passing through the second step section and the first face; the first face, second face, third face, first step section and second step section extending between first and second ends;

(b) a plurality of first conductive terminals each having opposed ends, one end of each first conductive terminal being inserted in at least one of the first and second insertion slots of the first and second step sections of the pin socket, the other end of each first conductive terminal being soldered on the circuit board; and, (c) a plurality of second conductive terminals each having opposed ends, one end of each second conductive terminal being inserted in one insertion hole of the pin socket, the other end of each second conductive terminal being soldered on the circuit board.

* * * * *